US007934274B2

(12) United States Patent
Forrest et al.

(10) Patent No.: US 7,934,274 B2
(45) Date of Patent: May 3, 2011

(54) NON-CIRCULAR SECTION GRAB BAR

(75) Inventors: Earl David Forrest, Asheboro, NC (US); Andrew James Graff, Greensboro, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 586 days.

(21) Appl. No.: 12/032,782

(22) Filed: Feb. 18, 2008

(65) Prior Publication Data

US 2009/0205124 A1 Aug. 20, 2009

(51) Int. Cl.
*A47K 3/024* (2006.01)

(52) U.S. Cl. ..... 4/576.1; 211/105.1; 248/251

(58) Field of Classification Search ..... 4/576.1–577.1; 248/251, 254, 262, 267; 211/105.1, 16, 88.04, 211/105.2; D23/304; 138/89
See application file for complete search history.

(56) References Cited

U.S. PATENT DOCUMENTS

| | | | | |
|---|---|---|---|---|
| 2,720,317 | A * | 10/1955 | Stroud | 211/105.2 |
| 3,098,240 | A * | 7/1963 | Fleenor | 4/576.1 |
| 3,578,027 | A * | 5/1971 | Zopfi | 138/89 |
| 4,602,766 | A * | 7/1986 | Naka et al. | 256/59 |
| 5,190,267 | A * | 3/1993 | Schmitt et al. | 256/59 |
| 5,860,538 | A * | 1/1999 | Duero et al. | 211/123 |
| 6,032,694 | A * | 3/2000 | Wellen et al. | 138/89 |
| 6,430,759 | B1 * | 8/2002 | Beltran | 4/576.1 |
| 6,561,499 | B2 * | 5/2003 | Lesenskyj et al. | 256/65.01 |
| 6,796,442 | B1 * | 9/2004 | Wu | 211/105.1 |

* cited by examiner

*Primary Examiner* — Charles Phillips
(74) *Attorney, Agent, or Firm* — Carlson, Gaskey & Olds

(57) ABSTRACT

A grab bar for attachment to a bathroom wall structure includes a body member that extends between first and second ends. The body member is defined by a non-circular cross-section.

14 Claims, 2 Drawing Sheets

NON-CIRCULAR SECTION GRAB BAR

TECHNICAL FIELD

This invention relates to a bar that is utilized in bathrooms, such as a grab bar for example, where the bar is formed with a non-circular cross-section.

BACKGROUND OF THE INVENTION

Grab bars are utilized in bathroom applications to provide support for an individual during exit or entry in a bathtub or shower, for example. Typical grab bars include a linear/straight body member that is spaced apart from, and parallel to, a wall. The grab bar has end mounts that extend toward the wall such that the grab bar can be mounted to the wall. In some configurations, the linear/straight body member may include angled portions such that the grab bar can be gripped at different orientations.

These known grab bars are each defined by a circular cross-section. This traditional cross-section has been used due to the ease in manufacturing of the simple shape. Further, the circular section bar can be easily bent to form various angled portions. However, it is important to further improve grab bars to provide a more aesthetically pleasing appearance as well as providing a structure that can be more easily gripped by an individual. Further, it is desirable to provide a more secure attachment interface between such a grab bar and the wall without adversely affecting overall cost of the product.

SUMMARY OF THE INVENTION

A grab bar for use in a bathroom structure such as a shower or tub, for example, includes a non-circular cross-section.

In one example, the grab bar is comprised of a hollow body member that has first and second ends. The hollow body member is defined by a wall having an inner surface and an outer surface that are separated by a thickness. In one example, the non-circular cross-section comprises a substantially oval cross-section, which facilitates gripping.

In one example, a deviation portion is formed within the wall. The deviation portion forms a slight deviation of the oval shape, which further facilitates gripping.

In one example, a mounting post, base flange member, and fastener are used to secure the hollow body member to a bathroom wall structure. The hollow body member includes an elongated slot through which the fastener extends. The elongated slot allows the mounting post to be adjusted relative to the hollow body member to facilitate installation.

These and other features of the present invention can be best understood from the following specification and drawings, the following of which is a brief description.

DETAILED DESCRIPTION OF THE PREFERRED EMBODIMENT

Figure 1:
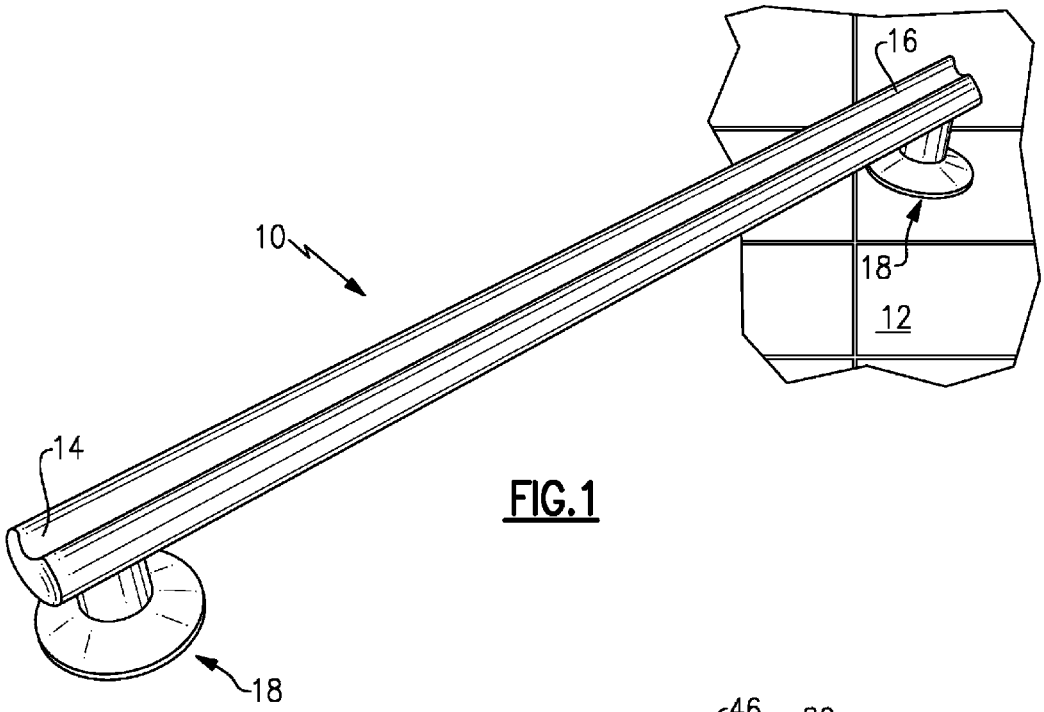
FIG. 1 is a perspective view of a straight grab bar and mounting assembly.

A grab bar 10 for attachment to a bathroom wall structure 12 is shown in FIG. 1. The grab bar 10 includes first 14 and second 16 ends. A mounting assembly 18 is positioned near each of the first 14 and second 16 ends such that the grab bar 10 can be secured to the bathroom wall structure 12. In the example shown in FIG. 1, the grab bar 10 is a generally straight configuration; however, the grab bar 10 could include one or more angled portions 20, such as that shown in FIG. 2. Further, while two mounting assemblies 18 are shown, a single or additional mounting assemblies could be used dependent upon length and the overall design configuration of the grab bar 10.

Figure 2:
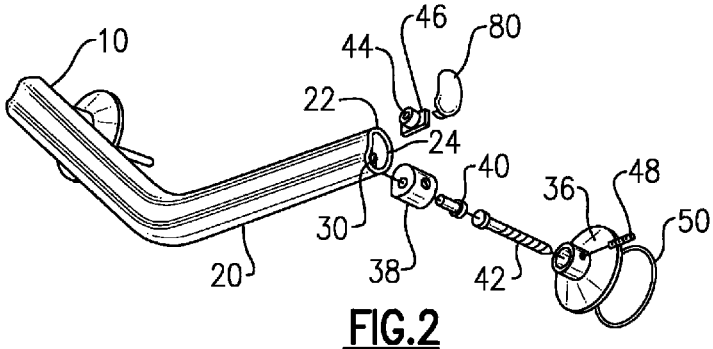
FIG. 2 is an exploded view of the mounting assembly of FIG. 1 with a grab bar having an angled portion.

As shown in FIG. 2, the grab bar 10 is comprised of a hollow body structure or member 22 that is defined by a non-circular cross-section. In one example, the hollow body member 22 is formed from an aluminum extrusion that can be bent and/or formed to provide a desired shape, such as to include angled portions 20, for example. Providing a non-circular shape is more aesthetically pleasing and less institutional in appearance than circular cross-section configurations. Further, the non-circular cross-section of the hollow body member 22 provides a better grip than circular cross-sections.

Figure 3:
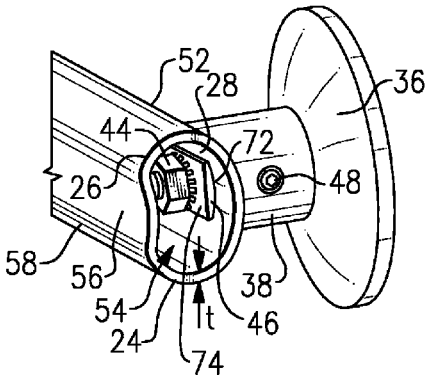
FIG. 3 is an end view of the grab bar and mounting assembly of FIG. 1 with an end cap removed.

In the example shown in FIGS. 2 and 3, the non-circular cross-section comprises a substantially oval shape. The hollow body member 22 is defined by a wall 24 having an outer surface 26 and an inner surface 28 that are separated by a thickness t. In one example, the wall thickness t is generally uniform throughout the hollow body member 22.

Figure 5:
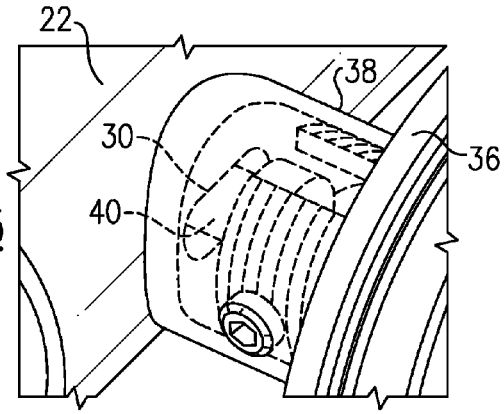
FIG. 5 is an enlarged perspective assembled view of the mounting assembly with an elongated slot formed within the grab bar.

A thru-hole comprising an elongated slot 30 (FIG. 5) is formed within the wall 24. Each mounting assembly 18 includes a base flange member 36, a mounting post 38, a first fastener 40 that secures the mounting post 38 to the hollow body member 22, a second fastener 42 that secures the hollow-body member 22 to the bathroom wall structure 12, a locking nut 44 that cooperates with the first fastener 40, and a washer 46 that cooperates with the locking nut 44. A set screw 48 is used to secure the mounting post 38 to the base flange member 36 (FIG. 3), and an o-ring seal member 50 is positioned at the base flange member 36 to provide a sealed interface. When installed as shown in FIG. 3, the mounting post 38 is positioned on a wall facing side 52 of the hollow body member 22, with the locking nut 44 and washer 46 being positioned within a cavity 54 formed within the hollow body member 22.

A deviation portion 56 is formed within the hollow body member 22 in a front facing side 58 that is opposite the wall facing side 52. The deviation portion 56 forms a slight deviation from a perfect oval shape cross-section. This deviation portion 56 further facilitates gripping of the grab bar 10 by an individual, as well as further enhancing the aesthetic appearance of the grab bar 10.

Figure 4A:
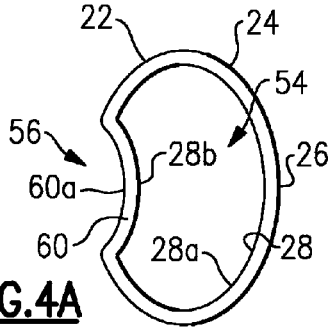
FIG. 4A is one example of a grab bar cross-section.

In one example shown in FIG. 3 and FIG. 4A, the deviation portion 56 comprises a recessed portion 60 with a surface that extends inwardly toward a center of the cavity 54. In this example, the recessed portion 60 comprises a curved surface 60*a*. As such, the inner surface 28 of the wall 24 is substantially comprised of a concave surface 28*a* and includes a convex portion 28*b* located at the recessed portion 60.

Figure 4C:
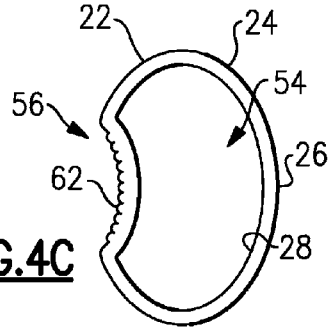
FIG. 4C is another example of a grab bar cross-section.
Figure 4B:
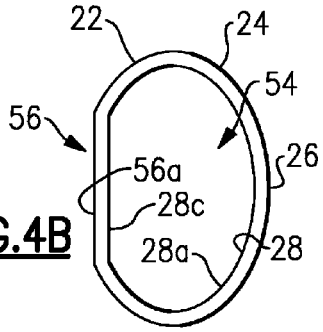
FIG. 4B is another example of a grab bar cross-section.

In the example shown in FIG. 4B, the deviation portion 56 comprises a generally linear surface 56*a*. In this configuration, the inner surface 28 of the wall 24 is substantially comprised of a concave surface 28*a* with a flattened surface 28*c*.

The example shown in FIG. 4C is similar to that of FIG. 4A and includes a non-smooth surface 62 that could comprise a ribbed or otherwise textured surface. This non-smooth surface 62 further facilitates gripping and can be used in any of the various different deviation portion configurations.

Figure 4D:
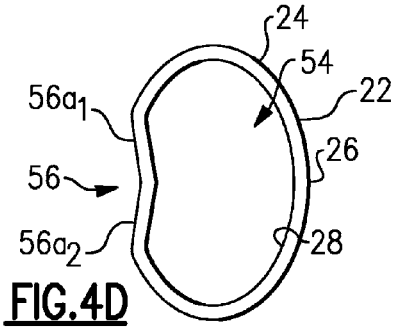
FIG. 4D is another example of a grab bar cross-section.

In the example shown in FIG. 4D, the deviation portion 56 comprises a plurality of linear surfaces $\mathbf{56}a_1$, $\mathbf{56}a_2$ that extend inwardly toward a center of the cavity 54.

Figure 6:
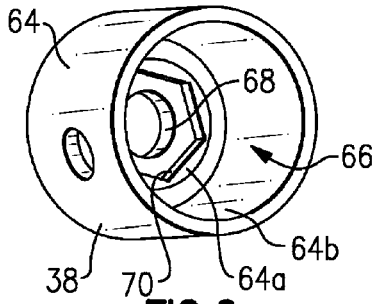
FIG. 6 is a perspective view of a mounting post from the mounting assembly.

During assembly, the first fastener 40, which in this example comprises a hex head bolt, is fitted into the mounting post 38. As shown in FIG. 6, the mounting post 38 comprises a socket or cup-shaped body 64 that includes a base portion 64*a* and a wall portion 64*b* extending outwardly around a perimeter of the base portion 64*a* to form a cavity 66.

A mount hole 68 is formed within the base portion 64*a* and is aligned with the elongated slot 30 in the hollow body member 22. A fastener feature 70 is formed within the base portion 64*a* about the mount hole 68. In the example shown, the fastener feature 70 corresponds in shape to a shape of a head of the first fastener 40 and can be formed by molding. As such, the head of the first fastener 40 is fitted into the fastener feature 70 that is formed within the mounting post 38. In the example shown, the fastener feature 70 comprises a hexagonal shape. The purpose of the fastener feature 70 is to hold the fastener 40 from turning during assembly and adjustment, while using just one tool for tightening.

The first fastener 40 then passes through the elongated slot 30 (FIG. 5) in the hollow body member 22, which allows the position of the mounting post 38 to be repeatedly adjusted relative to the grab bar 10 to allow for manufacturing tolerances. This feature also allows installers to make field adjustments as needed to account for drilling errors in mounting surfaces on the bathroom wall structure 12.

The first fastener 40 then passes through the washer 46 and into the locking nut 44, which are both positioned within the cavity 54 of the grab bar 10. As best shown in FIG. 3, the washer 46 includes a curved surface portion 72 that closely matches an inside curvature of the inner surface 28, and a flat surface portion 74 that is opposite the curved surface portion 72. The locking nut 44 rests against the flat surface portion 74. This allows for more direct clamping forces to be applied from the mounting post 38 to the grab bar 10, and substantially reduces the likelihood of grab bar movement.

In one example, the washer 46 is formed as an extruded component. By using such a washer, forming a flat surface within the body of the grab bar itself, which would be costly, is avoided. As such, the washer 46 provides raw material cost savings and also facilitates bending and forming the grab bar as a flat bar surface is not required for mounting purposes.

Figure 7:
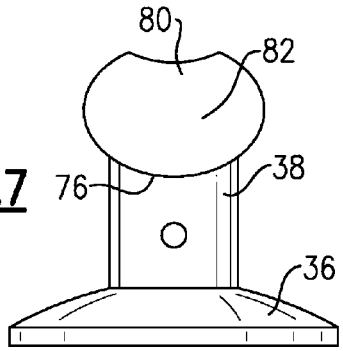
FIG. 7 is an end view showing an interface between the grab bar and the mounting post.

The mounting post 38 also includes an interface surface 76, shown in FIG. 7, which generally corresponds in shape and trajectory to an outer curvature of the outer surface 26 on the wall facing side 52 of the grab bar 10. This also aids in the prevention of movement once the mounting assembly is securely tightened.

Figure 8:
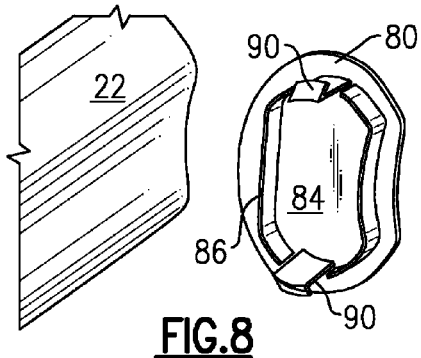
FIG. 8 is a perspective view of an end cap that encloses ends of the grab bar.

End caps 80 are used to enclose the first 14 and second 16 ends of the grab bar 10 as shown in FIGS. 2, 7, and 8. The end caps 80 include alignment and attachment features. Each end cap 80 includes an outward facing surface 82 (FIG. 7) and an inward facing surface 84 (FIG. 8). The inward facing surface 84 includes a rib 86 that extends inwardly toward the grab bar 10 to cooperate with the inner surface 28. A shape of the rib 86 corresponds closely to an inside profile of the hollow body member 22. The rib 86 can be formed to be continuous or discontinuous about the inside profile. The rib 86 cooperates with the inner surface 28 to ensure that the end cap 80 is properly aligned relative to the grab bar 10.

At least one compression finger 90 (two are shown in FIG. 8) is used to secure the end cap 80 to the grab bar 10. The compression fingers 90 are biased against the inner surface 28 of the grab bar 10 to hold the end cap 80 in place.

In one example, the end caps 80 are formed from injection molded plastic. This allows the grab bar 10 to be finished off with generous radii at the ends for an aesthetically pleasing appearance.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A bathroom grab bar comprising:

a body member including at least two attachment interfaces for attachment to a bathroom wall structure, said body member being defined by a non-circular cross-section;

a base flange member adapted for attachment to the bathroom wall structure;

a mounting post comprising a cup-shaped body that is securable to said base flange member; and wherein said body member is a hollow structure defined by a wall having an inner surface and an outer surface that are separated by a thickness, and wherein said at least one attachment interface includes at least one elongated slot formed within said wall to allow a position of said mounting post to be adjustable relative to said body member.

2. The bathroom grab bar according to claim 1 wherein said non-circular cross-section comprises a substantially oval cross-section.

3. The bathroom grab bar according to claim 1 wherein said body member includes a first side to face the bathroom wall structure and a second side to face opposite from said second side, and wherein said second side of said body member includes a deviation portion formed within said wall.

4. The bathroom grab bar according to claim 3 wherein said outer surface of said wall includes a non-smooth surface at said deviation portion.

5. The bathroom grab bar according to claim 3 wherein said deviation portion comprises a recessed portion that extends inwardly toward a center of said hollow structure, said inner surface of said wall comprising a concave surface with a convex portion located at said recessed portion.

6. The bathroom grab bar according to claim 3 wherein said deviation portion comprises a linear portion with said inner surface of said wall comprising a concave surface and a flat surface portion located at said linear portion.

7. The bathroom grab bar according to claim 1 wherein said cup-shaped body includes a base portion with a mount hole that is aligned with said elongated slot, said base portion including a fastener feature formed about said mount hole, and wherein a first fastener is associated with said fastener feature such that said first fastener and said mounting post cannot rotate relative to each other, and including a washer and a lock nut positioned within a hollow cavity of said body member wherein said first fastener is inserted through said washer and said lock nut with said lock nut being tightened against said washer to clamp said mounting post to said body member.

8. The bathroom grab bar according to claim 7 wherein one side of said washer has a curved surface portion that matches an inside curvature of said inner surface of said body member and an opposite side of said washer has a flat surface portion that abuts directly against said lock nut.

9. The bathroom grab bar according to claim 1 including a washer and locking nut positioned within said hollow structure at said at least one elongated slot.

10. The bathroom grab bar according to claim 9 wherein said cup-shaped body includes a base portion with a mount hole, said base portion including a fastener feature formed about said mount hole, said fastener feature corresponding in shape to a shape of a head of a fastener that secures said mounting post to said body member.

11. The bathroom grab bar according to claim 1 wherein said body member has first and second ends, and including first and second end caps that enclose said hollow structure at said first and second ends, wherein each of said first and second end caps includes at least one of an alignment feature and an attachment feature that cooperates with said inner surface to align and attach said first and second end caps to said body member.

12. The bathroom grab bar according to claim 11 wherein each end cap includes said alignment feature and said attachment feature, and wherein said alignment feature comprises a rib that extends out from an inwardly facing surface of said end cap and into a hollow cavity of said body member to engage said inner surface, and wherein said attachment feature comprises at least one resilient finger that is compressible radially inwardly during insertion of said rib into said hollow cavity such that said at least one resilient finger is biased against said inner surface of said body member to secure a respective one of said first and second end caps to said body member.

13. The bathroom grab bar according to claim 11 wherein said attachment feature comprises at least one compression finger that is biased against said inner surface.

14. The bathroom grab bar according to claim 11 wherein said alignment feature comprises an inwardly extending rib having a shape that corresponds at least in part to a shape defined by said inner surface of said wall.

* * * * *